US010636395B1

(12) United States Patent
Backun et al.

(10) Patent No.: US 10,636,395 B1
(45) Date of Patent: Apr. 28, 2020

(54) MUSICAL INSTRUMENT HAVING A CARBON FIBER BODY JOINED WITH A WOODEN CORE

(71) Applicant: Backun Musical Services Ltd., Burnaby (CA)

(72) Inventors: Jeremy Backun, Vancouver (CA); Joel Jaffe, Richmond (CA)

(73) Assignee: BACKUN MUSICAL SERVICES LTD., B.C. (CA)

( * ) Notice: Subject to any disclaimer, the term of this patent is extended or adjusted under 35 U.S.C. 154(b) by 0 days.

(21) Appl. No.: 16/192,007

(22) Filed: Nov. 15, 2018

Related U.S. Application Data

(60) Provisional application No. 62/586,365, filed on Nov. 15, 2017.

(51) Int. Cl.
*G10D 9/08* (2020.01)
*G10D 7/066* (2020.01)

(52) U.S. Cl.
CPC ..... *G10D 9/08* (2020.02); *G10D 7/066* (2013.01)

(58) Field of Classification Search
CPC ..... G10D 7/005; G10D 7/066
See application file for complete search history.

(56) References Cited

U.S. PATENT DOCUMENTS 2,301,184 A * 11/1942 Arnold ..... G10H 1/32 84/742
2003/0070530 A1* 4/2003 McAleenan ..... G10B 3/08 84/380 R

* cited by examiner

*Primary Examiner* — Kimberly R Lockett
(74) *Attorney, Agent, or Firm* — Risso I.P.

(57) ABSTRACT

Described is a musical instrument having a carbon fiber body joined with a wooden core, including a method for forming such a musical instrument. Specifically, the musical instrument includes a body portion having carbon fiber wrapped around and adhered to a wooden core. The wooden core includes a bore therethrough to define a flow path through which air travels in the musical instrument through the body portion. Additionally, a plurality of tone holes are formed through the carbon fiber and wooden core and into the bore. Keywork can be applied to the tone holes to form a clarinet or other wood wind instrument as applicable to the particular design as implemented.

14 Claims, 16 Drawing Sheets

200

MUSICAL INSTRUMENT HAVING A CARBON FIBER BODY JOINED WITH A WOODEN CORE

CROSS-REFERENCE TO RELATED APPLICATIONS

The present application is a non-provisional application of U.S. Provisional Application No. 62/586,365, filed Nov. 15, 2017.

BACKGROUND OF THE INVENTION

(1) Field of Invention

The present invention relates to a musical instrument and, more particularly to a musical instrument having a carbon fiber body joined with a wooden core.

(2) Description of Related Art

Musical instruments have been in the art for many years and are typically formed of wood. The clarinet, for example, is a musical-instrument family belonging to the group known as the woodwind instruments. As illustrated in FIG. 1, woodwind instruments such as the clarinet 100 are generally formed to include a single-reed mouthpiece 102, a straight cylindrical body 104 (body portion) with an almost cylindrical bore, and a flared bell 106. The cylindrical body 104 is formed of a wooden core that provides the tonal characteristics of the instruments. The cylindrical body 104 also includes the keywork 108 and tone holes that allow a musician to play the instrument. While generally operable, the wooden core is prone to warpage and/or cracking over time which decreases the strength, durability and musical/tonal characteristics of the instrument.

Thus, a continuing need exists for a musical instrument having a body portion formed of a material that addresses the issue of warpage and, in doing so, increases the strength, durability and musical/tonal characteristics of the instrument.

SUMMARY OF INVENTION

This disclosure is directed to a musical instrument having a carbon fiber body joined with a wooden core. Specifically, the musical instrument includes a body portion having carbon fiber wrapped around and adhered to a wooden core. The wooden core includes a bore therethrough to define a flow path through which air travels in the musical instrument through the body portion. Additionally, a plurality of tone holes are formed through the carbon fiber and wooden core and into the bore.

In another aspect, the body portion includes at least two tenons, each tenon having a wooden core inner diameter and a carbon fiber outer diameter.

In yet another aspect, both a mouthpiece and bell affixed with the tenons.

In another aspect, this disclosure is directed to a method for forming a musical instrument. The method includes several acts, including forming a body portion such that the body portion includes carbon fiber wrapped around and adhered to a wooden core, wherein the wooden core includes a bore therethrough and a plurality of tone holes formed through the carbon fiber and wooden core and into the bore.

Additionally, forming the body portion further comprises acts of adhering a carbon fiber sheet to the wooden core; and forming the one or more tone holes through the carbon fiber sheet and wooden core.

In yet another aspect, adhering the carbon fiber sheet to the wooden core further comprises acts of:

- drilling a bore through a wooden blank to form a bore therethrough, the wooden blank having an outer diameter and inner diameter defined by the bore;
- turning down the outer diameter of the wooden blank to form the wooden core;
- securing the wooden core between a pair of mandrels to form a mandrel-wooden core assembly;
- mounting the mandrel-wooden core assembly to a lathe;
- adhering a first end of a carbon fiber sheet to the wooden core;
- wrapping the carbon fiber sheet around the wooden core while applying an adhesive to the carbon fiber sheet and maintaining the carbon fiber sheet under tension to form a carbon fiber wrapped body;
- wrapping and securing a securement layer around the carbon fiber wrapped body to allow the adhesive to cure; and
- once cured, turning down an outer diameter of the carbon fiber wrapped body such that the outer diameter of the carbon fiber wrapped body is concentric with the inner diameter defined by the bore to form a concentric tube.

In yet another aspect, the method further comprises acts of:

- forming tenons on opposing ends of the concentric tube;
- reinforcing the tenons by applying an adhesive around the tenons;
- turning down the tenons to a desired size;
- forming tone holes with blind pockets through the carbon fiber wrapped body and into the wooden core;
- filling one or more of the tone holes and blind pockets with a filler;
- applying an external epoxy layer around the carbon fiber wrapped body;
- turning down the external epoxy layer to a final outer diameter dimension;
- polishing the external epoxy layer to a desired gloss;
- forming one or more raised tone holes by affixing a wooden plug in a pocket;
- machining all tone holes; and
- cleaning the external epoxy layer, thereby forming the body portion having a carbon fiber body adhered to the wooden core.

In another aspect, in turning down the outer diameter of the wooden blank to form the wooden core, an outer surface of the wooden core includes smooth flat rings wrapping around the wooden core, with a low helix thread formed between the smooth flat rings.

Further, the carbon fiber sheet is maintained under tension by feeding the carbon fiber sheet up a ramp toward the wooden core while a free end of the carbon fiber sheet is affixed with a weight block.

In another aspect, the method includes an act of applying hot air to the adhesive and carbon fiber sheet when wrapping the carbon fiber sheet around the wooden core.

Additionally, the securement layer is wax paper, with the wax paper being secured around the carbon fiber wrapped body using a helix of tape.

Finally, as can be appreciated by one in the art, the present invention also comprises a musical instrument formed according to the process as described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

The present invention relates to a musical instrument and, more particularly to a musical instrument having a carbon fiber body joined with a wooden core. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

Figure 1:
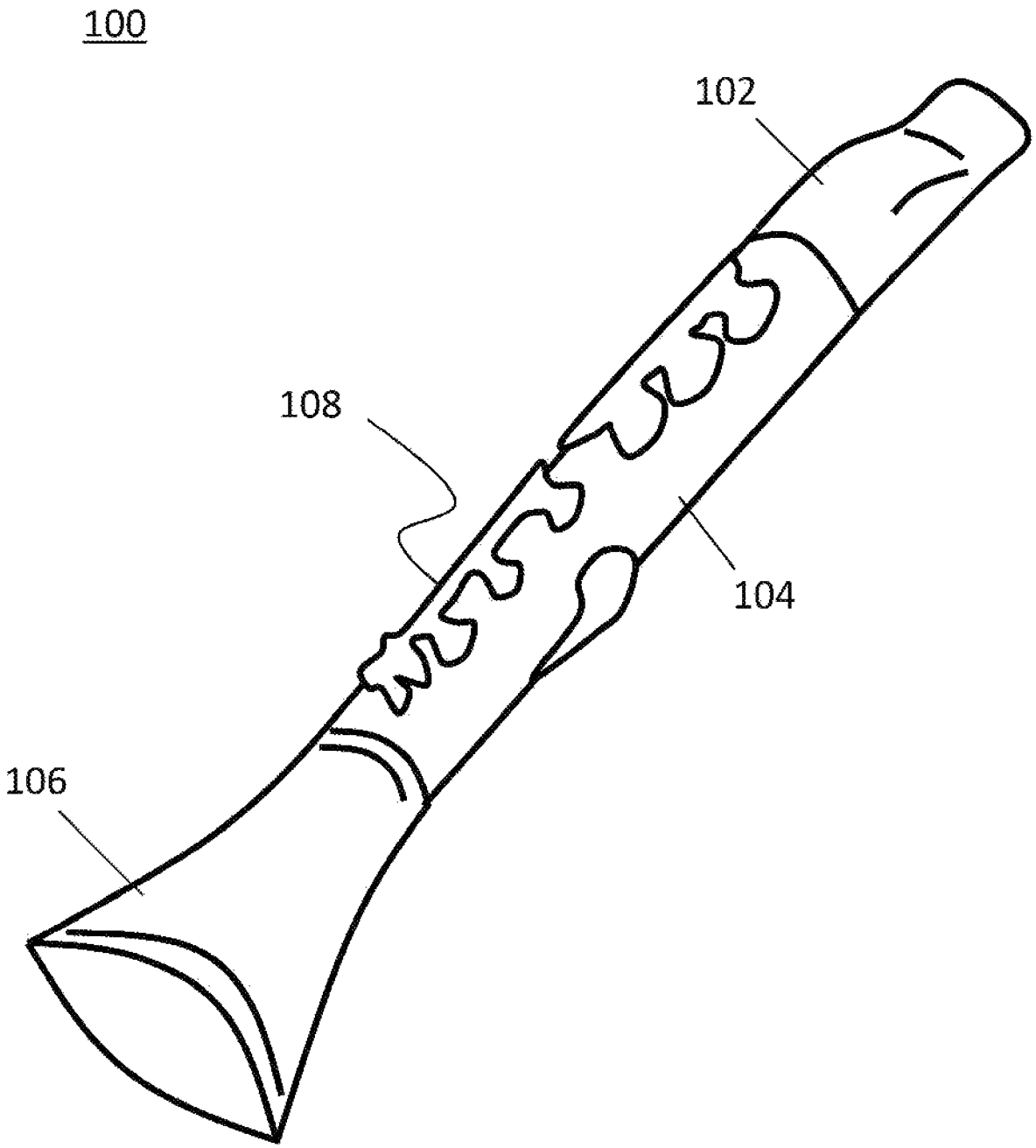
FIG. 1 (Prior Art)
FIG. 1 is an illustration of a traditional clarinet.
Figure 2A:
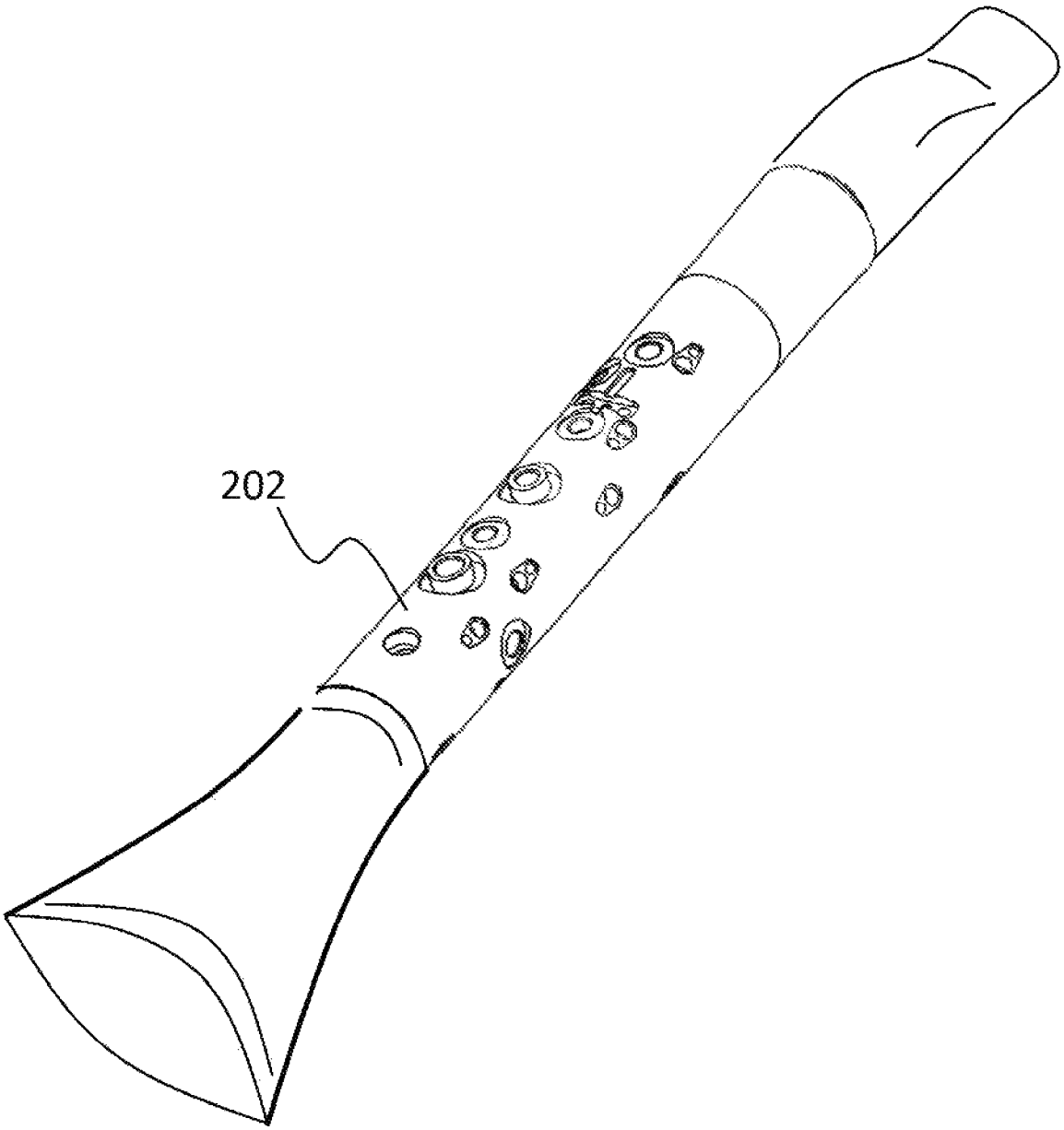
FIG. 2A is an illustration of a musical instrument having a body portion formed of a carbon fiber body joined with a wooden core according to various aspects of the present invention.
Figure 2B:
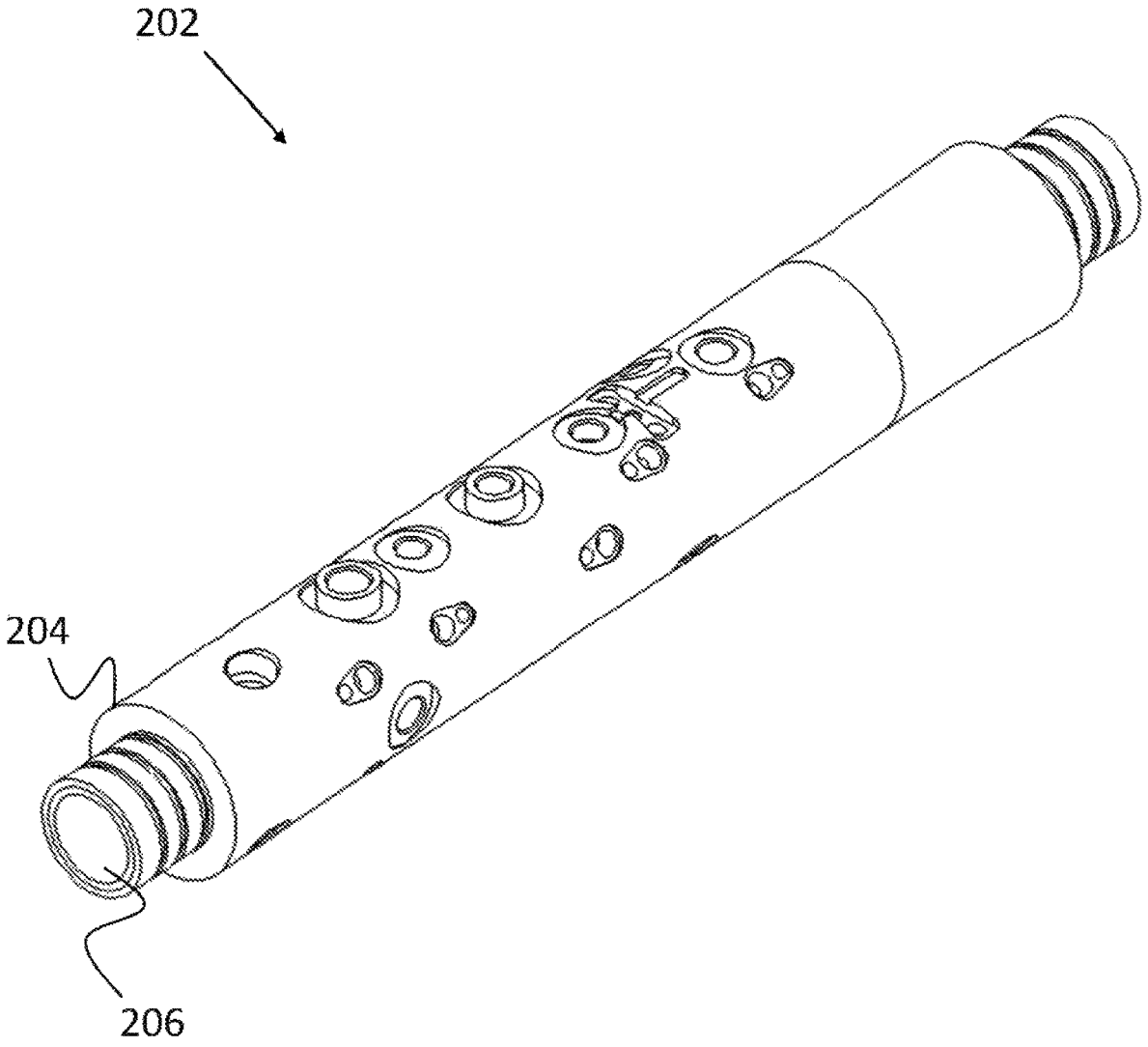
FIG. 2B is an illustration of the carbon fiber body joined with the wooden core for use as the body portion in a musical instrument according to various aspects of the present invention.

As noted above and as depicted in FIG. 2A, the present disclosure is directed to a musical instrument 200 having a unique body portion 202 (keywork removed for illustrative purposes), and a method for forming such an instrument and/or body portion 202. Notably and as shown in FIG. 2B, the body portion 202 is formed to include a carbon fiber body 204 joined with a wooden core 206. The fusion of carbon fiber to woodwind musical instruments dramatically improves the strength, durability and musical/tonal characteristics of the instrument. It should be understood that although a clarinet is depicted as an example of such an instrument, the process described herein can be used with any wooden instrument. As a non-limiting example, the process was implemented on a Bb Clarinet, fusing the carbon fiber to cocobolo wood by the process of wrapping the carbon fiber through multiple layers over the wood. This significantly increased the strength of the wooden core, including the bore and tone holes of the instrument, which can often warp over time. The carbon fiber has completely prevented any such warpage.

Thus, this disclosure provides the first instrument and process of its kind that fuses a carbon fiber body 204 or synthetic materials to a wooden core 206, including the wooden tone holes, which are integral to the body of the wooden instrument. The invention of disclosure has applications outside of just clarinet and clarinet accessories, such as wooden flutes and piccolos, bassoons, oboes and English horns, all of which suffer from the variability of wood, which is neither reliable now or stable post manufacturing.

As noted above, the present invention relates to a wooden musical instrument that is fused with carbon fiber and a method for forming such an instrument. While one method for forming such an instrument is provided below, it should be understood that the invention is not intended to be limited thereto as there may be other methods that arrive at that instrument having a carbon fiber body joined to a wooden core. Further, additional or less steps may be performed (and in other ordering if appropriate) to form the instrument and/or body portion. Thus, specific details regarding one non-limiting example of forming the body portion (i.e., the carbon fiber body joined with the wooden core) are provided below.

Figure 3:
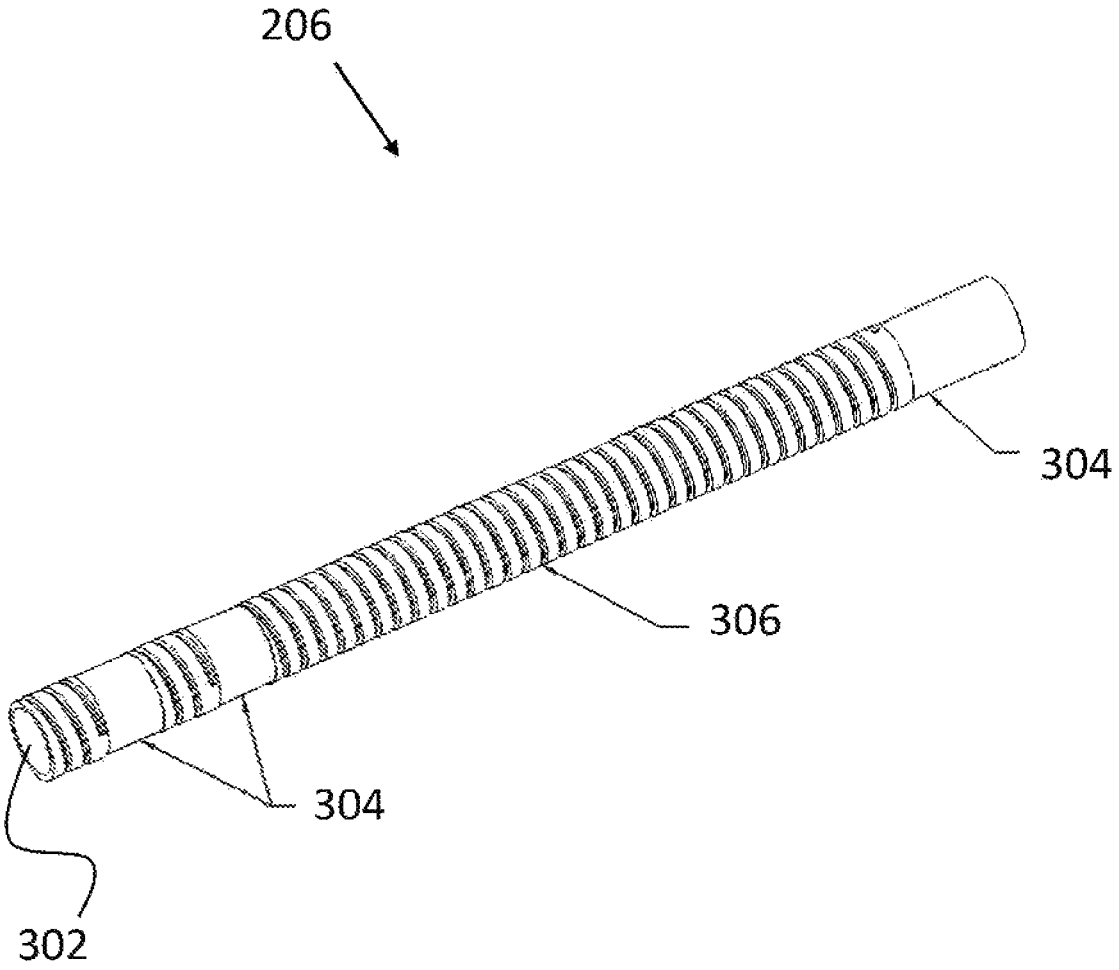
FIG. 3 is an illustration of a wooden core according to various aspects of the present invention.

As shown in FIG. 3, the body portion of the musical instrument includes a wooden blank with a bore 302 formed therethrough. The bore 302 defines a flow path through which air travels in the musical instrument and can be formed using any suitable mechanism, device, or technique. Desirably, the wooden blank is gun-drilled (forming the bore 302 or hole therethrough) and left to dry for a curing process. It can be left to air dry or provided with heat, etc. for a period of time to cure (e.g., minimum of 3 months, or other suitable curing time). The curing period allows the wooden blank to expand and contract and undergo natural deformation before it is ready to be further machined. Desirably, the bore 302 is formed prior to application of the carbon fiber to allow for proper curing. However, it should be noted that the bore 302 can be formed at any time during the manufacturing process.

The cured wooden blank is then held by its internal diameters on a lathe machine and turned down to size. A CNC lathe is desirably used for accuracy. The outer diameters of the wooden blank are then turned down to accommodate the carbon fiber wrapping process and form the resulting wooden core 206. Two important features of the wooden core 206 are the smooth flat rings 304 machined in at opposing ends and a captive low helix thread 306 that is aggressively machined in between them. This allows better glue adhesion for the carbon fiber to the wood.

Figure 4:
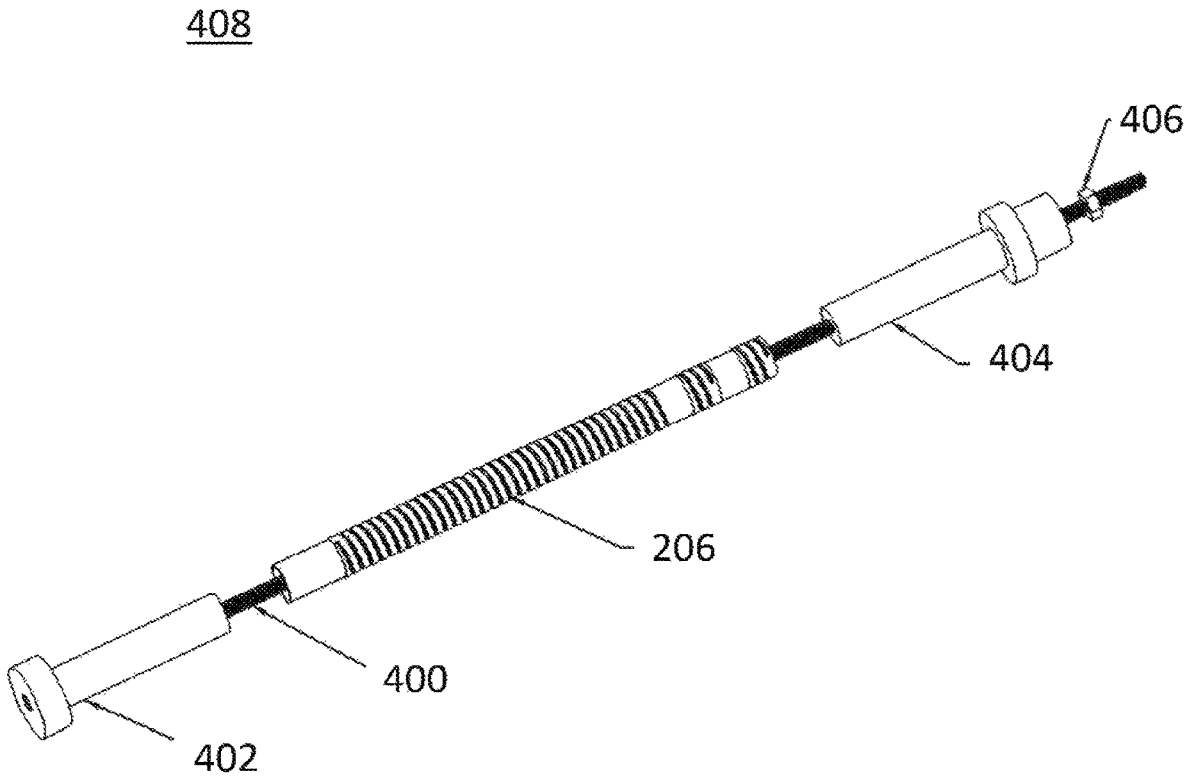
FIG. 4 is an exploded-view illustration of a custom mandrel and wooden core assembly according to various aspects of the present invention.
Figure 5:
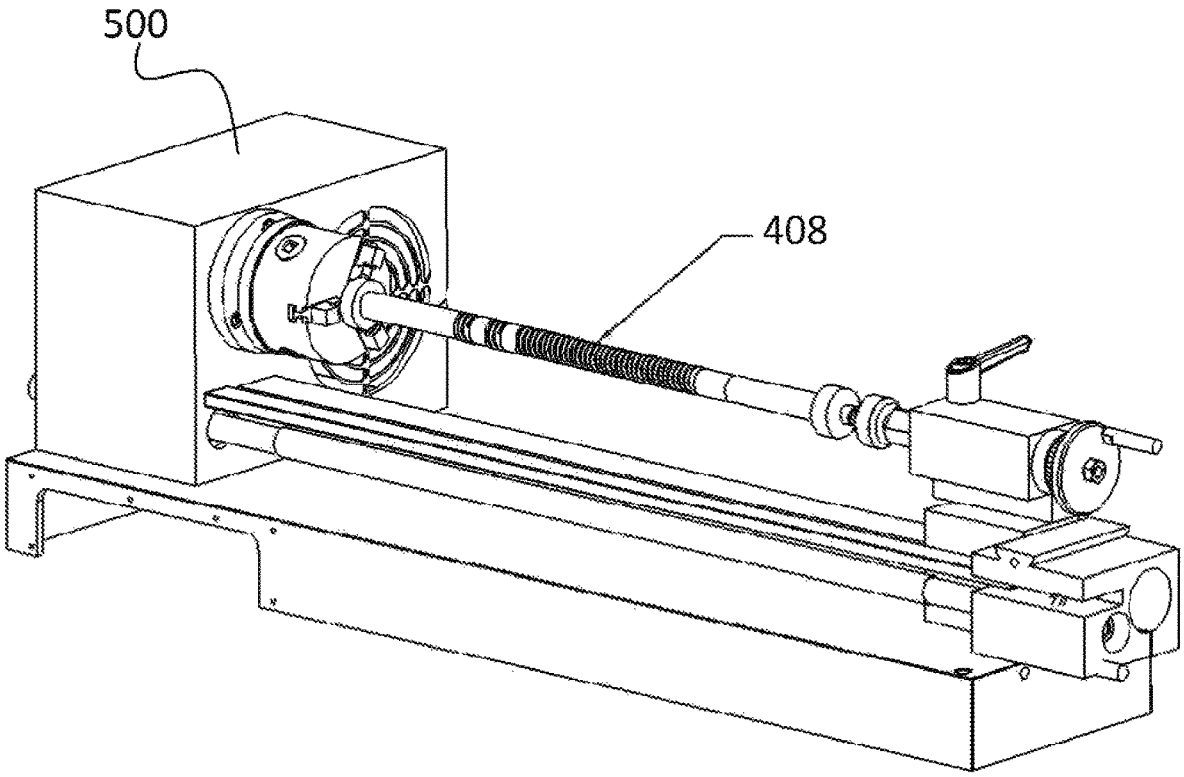
FIG. 5 is an illustration of the custom mandrel and wooden core assembly as mounted on a lathe according to various aspects of the present invention.

As shown in FIG. 4, the prepared wooden core 206 is placed between the ends of a custom-made mandrel, comprising of a threaded rod 400 and two bolsters (e.g., polyoxymethylene bolsters). The two bolsters operate as a mandrel dead end 402 and a mandrel spindle end 404. The wooden core 206 and bolsters are held onto the threaded rod 400 using any suitable fixture, such as a nut 406, etc. The threaded rod 400 can be formed of any suitably durable and rigid material, a non-limiting example of which includes a steel rod. The wooden core 206 affixed with the mandrel collectively forms a mandrel-wooden core assembly 408. As shown in FIG. 5, this mandrel-wooden core assembly 408 is then mounted to a lathe 500 (e.g., CNC lathe, etc.).

Figure 6:
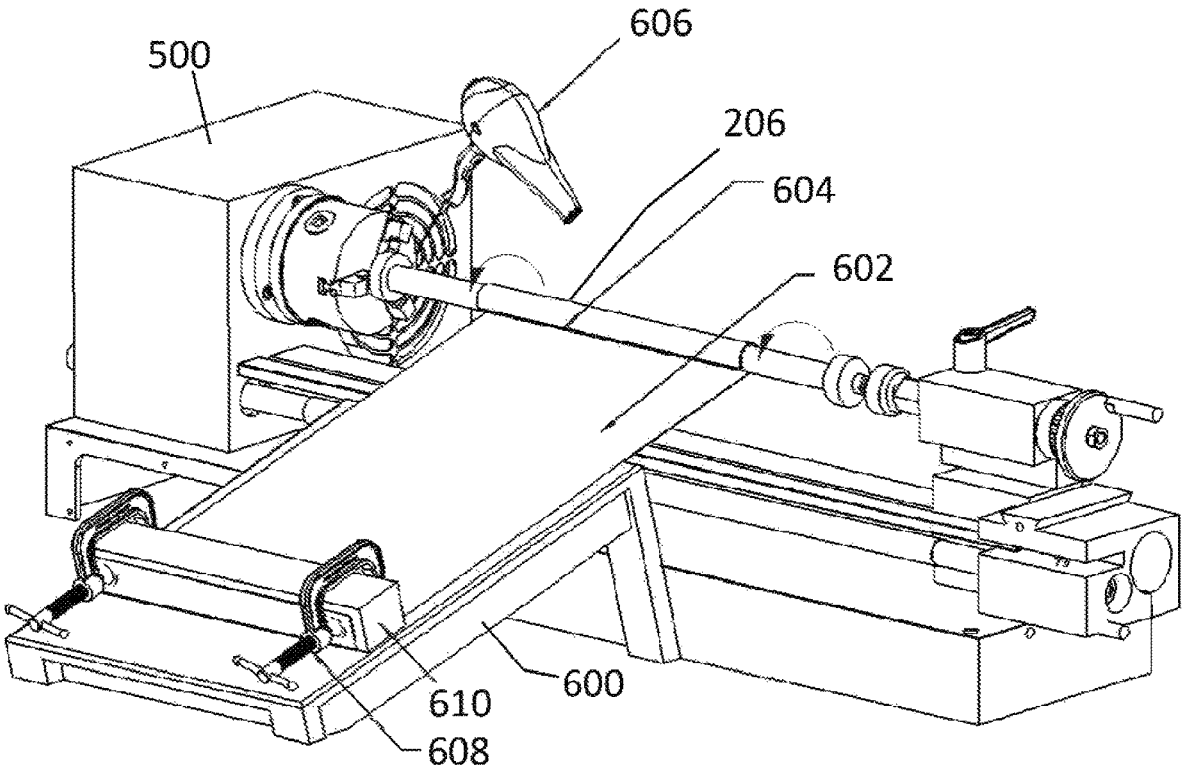
FIG. 6 is an illustration depicting a carbon fiber wrapping set-up according to various aspects of the present invention.

Through use of the lathe 500, one or more carbon fiber sheets can be easily applied and wrapped tightly around the wooden core 206. The carbon fiber sheets can be applied to the wooden core 206 using any suitable method or technique. As a non-limiting example and as shown in FIG. 6, a slanted bed/ramp assembly can be used as a feeder 600 into the lathe 500. The feeder 600 is set-up to facilitate placement and efficient movement of the carbon fiber sheet 602 during the wrapping process while maintaining tension on the carbon fiber sheet 602.

A custom cut carbon fiber sheet 602 is placed on the feeder 600 with one end being attached to the wooden core 206 with a suitable adhesive (e.g., a mildly acidic epoxy glue). This set up is now ready for the carbon fiber wrapping process.

In the wrapping process, the lathe 500 is turned on at a predetermined speed (e.g., low RPM) to start feeding the carbon fiber sheet 602 onto the wooden core 206 at a controlled rate. From this point there is an application of more epoxy followed by a controlled hot air blast which is continued until the sheet has been fully wrapped. Epoxy is applied 604 as needed to the rotating wood body, followed repeatedly by a controlled blast of hot air from an air dryer 606 (e.g., hot air blower such as a hair blow dryer, etc.) until the sheet 602 has been fully wrapped. In various aspects, the epoxy is applied 604 liberally and at the discretion of the operator.

During the entire wrapping process, tension is continuously applied on the carbon fiber sheet 602 to prevent the occurrence of any air pockets in the carbon fiber body. This can be easily achieved by clamping 608 the free end of the carbon fiber sheet 602 between two appropriate size weight blocks 610 (e.g., wooden blocks). The weight of these blocks 610 on the ramp ensures smooth and straight feeding of the carbon fiber sheet 602.

Figure 7:
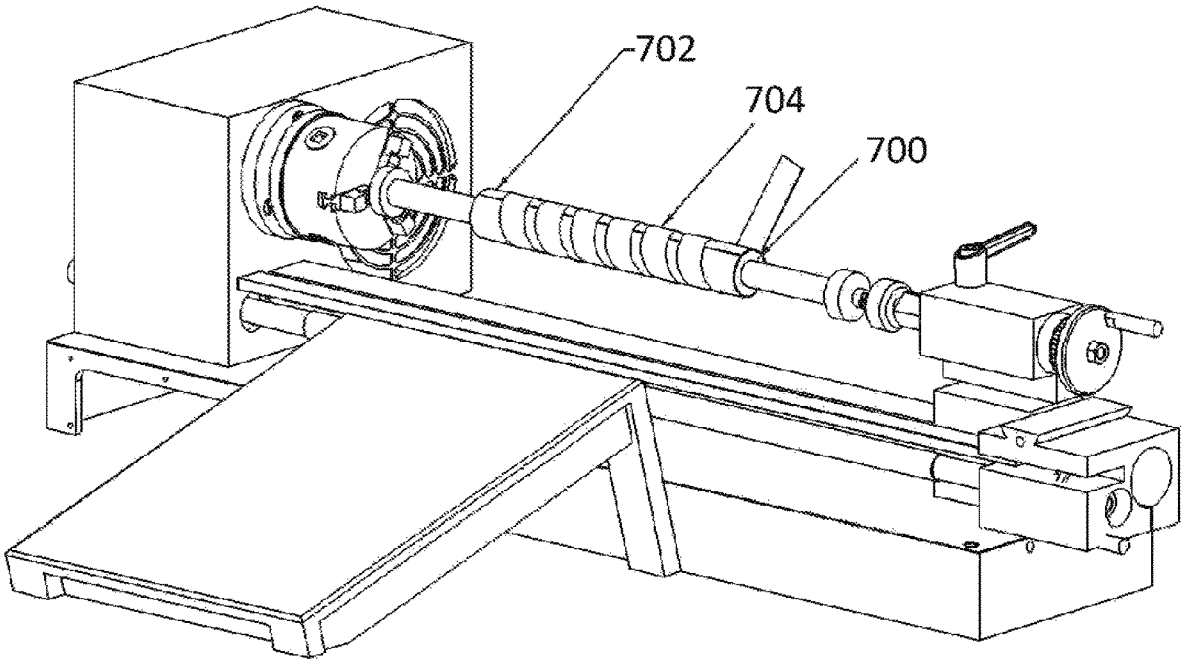
FIG. 7 is an illustration depicting a carbon fiber body as being wrapped in wax paper.

As shown in FIG. 7, once the wrap is finished (i.e., the carbon fiber sheet has been completely wound around the wooden core to form a carbon fiber wrapped body 700), the outer diameter of the carbon fiber wrapped body 700 is wrapped in a securement layer (e.g., wax paper 702). Further, a fixture (e.g., helix wrap of tape 704) is applied and wound around the securement layer (e.g., wax paper 702) to act as a clamp and securely hold the parts together. Thus, the securement layer is secured around the carbon fiber wrapped body. Once wound and secured, the carbon fiber wrapped body 700 is left to cure (e.g., for 48 hours, etc.) and let the epoxy set.

Figure 8:
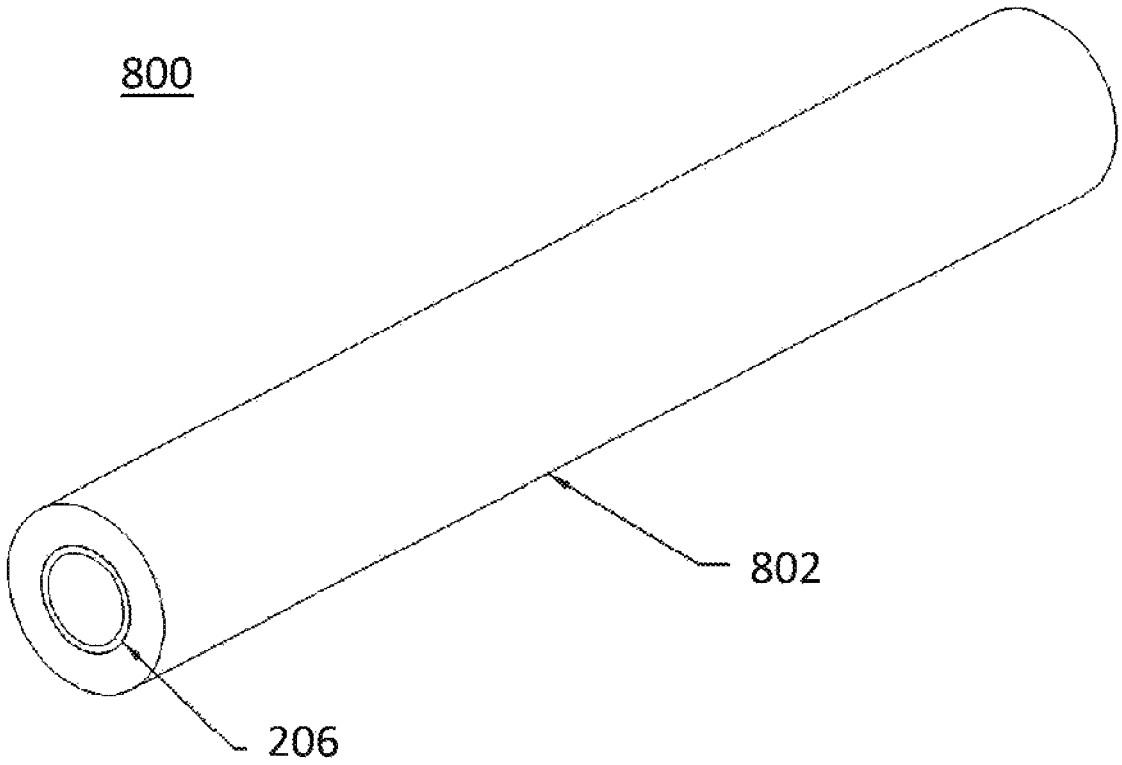
FIG. 8 is an illustration depicting the body portion, showing a wooden core as wrapped in carbon fiber to form a carbon fiber wrapped body according to various embodiments of the present invention.

Once cured, the wax paper and mandrel are removed (e.g., removed with a hammer, etc.). If desired and as shown in FIG. 8, the outer diameter of the carbon fiber wrapped body is turned down on a lathe (e.g., CNC lathe) to get the outer diameter concentric to the inner diameter, thereby forming a concentric tube 800. The concentric tube 800 is comprised of the wooden core 206 wrapped in carbon fiber 802.

Figure 9:
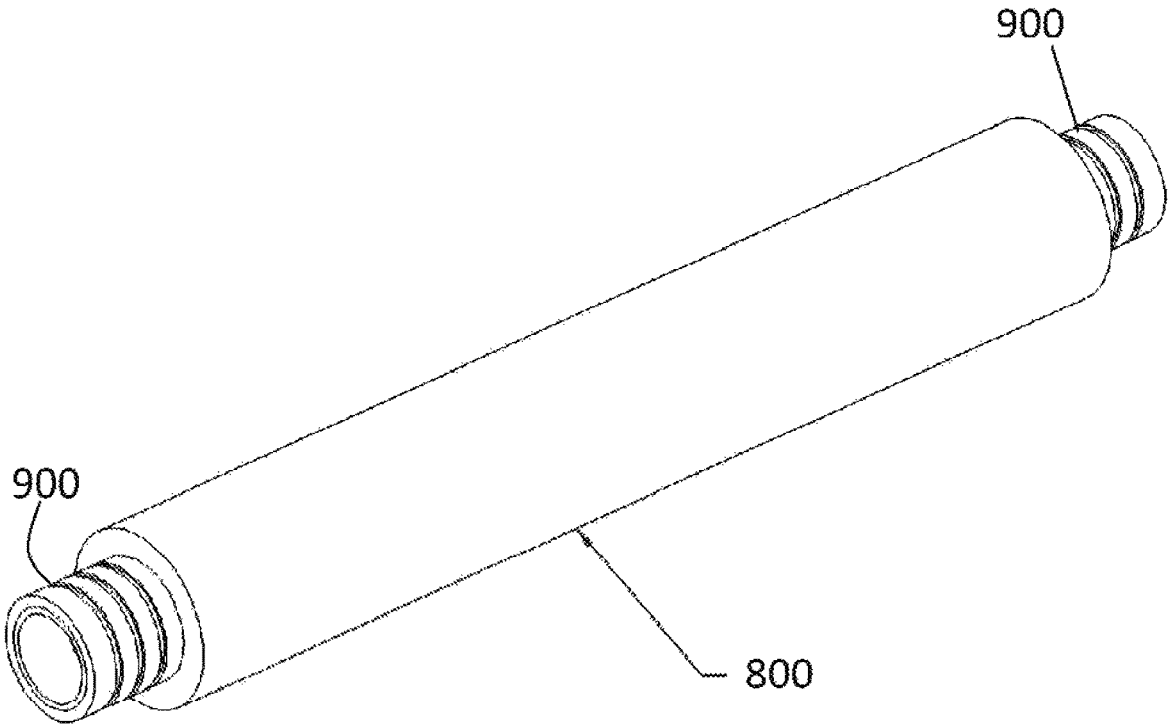
FIG. 9 is an illustration depicting the carbon fiber wrapped body with machined tenons and bore according to various embodiments of the present invention.

After the tube is made concentric and as shown in FIG. 9, the concentric tube 800 can be further processed in which the tenons 900 and bore are machined on the same or a different lathe.

The outer diameter surfaces of the tenons 900 are then reinforced with cyanoacrylate (CA) glue (or any other suitable material) and the item is machined again. For example, the part is transferred to another lathe where the outer body diameter shape (of the main body or barrel) is turned down to the appropriate diameter for the next CA glue process.

Figure 10:
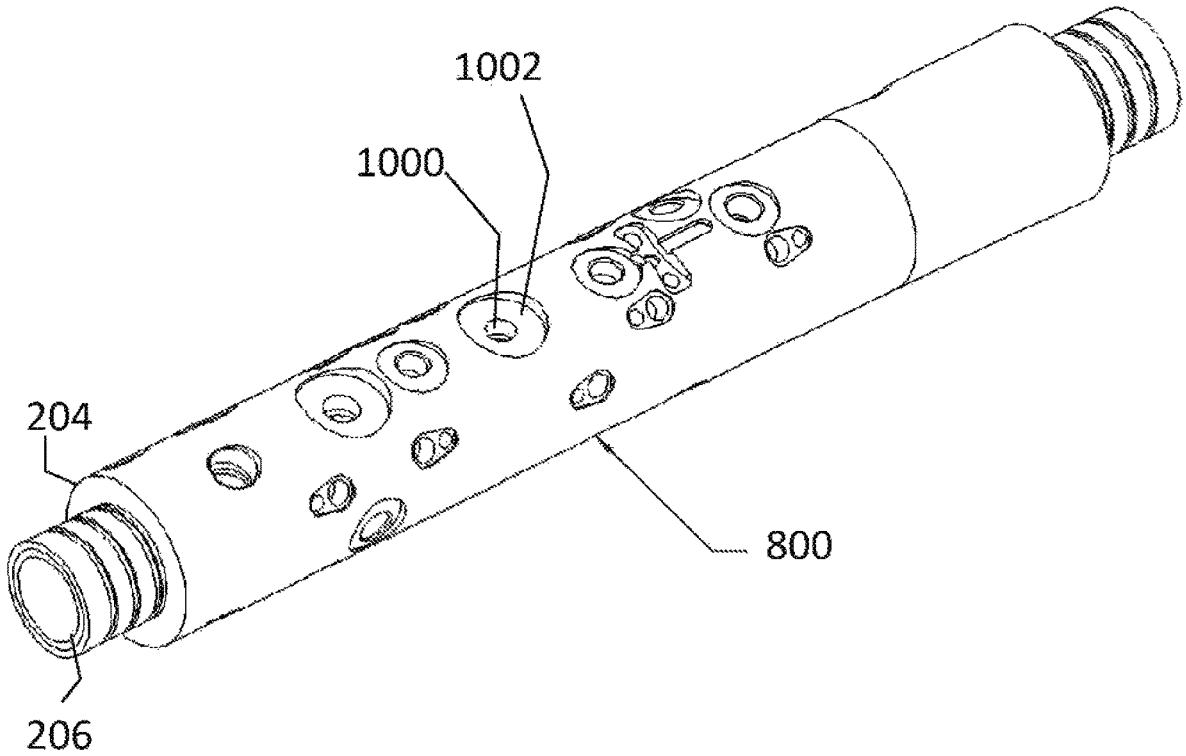
FIG. 10 is an illustration depicting the carbon fiber wrapped body with pockets according to various embodiments of the present invention.

As shown in FIG. 10, the concentric tube 800 is then transferred to a milling machine (e.g., CNC milling machine, etc.) or suitable equipment to have holes 1000 with blind pockets 1002 machined through the carbon fiber body 204 and into the wooden core 206. The holes 1000 will ultimately serve as tone holes for the keywork that can be added later. Further, at this stage the pockets 1002 do not pierce through the wooden core 206 to its internal bore and, instead, pass through the carbon barrier (i.e., carbon fiber sheet) and to the top side of the wooden core 206.

Figure 11:
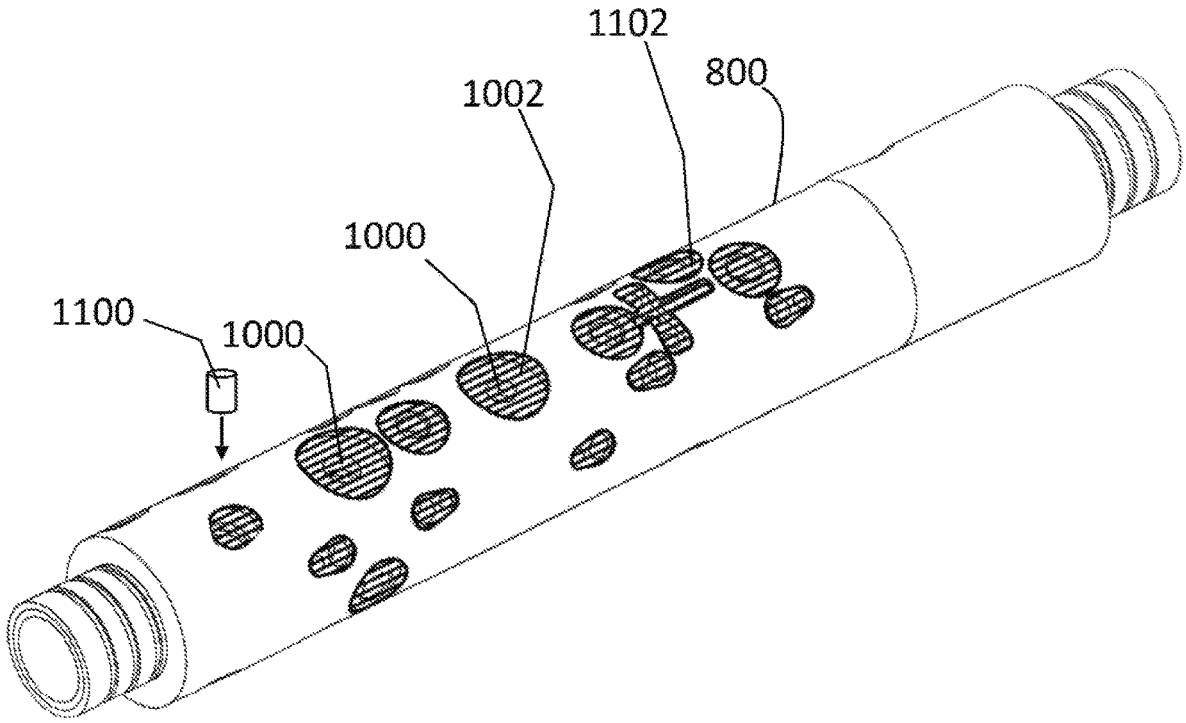
FIG. 11 is an illustration depicting the pockets as filled with adhesive or plugs according to various embodiments of the present invention.

As shown in FIG. 11, the blind pockets 1002 are filled with filler, such as epoxy 1102 or plugs. The concentric tube 800 is transferred to a CNC lathe (or other suitable equipment) where the final outer diameter shape is turned. Several specific holes 1000 are filled with custom plugs (e.g., wood or synthetic plugs, etc.) 1100 for protection from the next CA glue or epoxy layer. This is critical as these holes 1000 are used as a reference point for the infra-red (IR) calibration probe on the CNC mill to re-align the part when it is re-mounted.

The outer diameter is then desirably coated to have an external shell coating. For example, the outer diameter is coated in CA glue or other suitable material and once cured is machined to final size. The outer diameter is then polished to a desired gloss.

Figure 12:
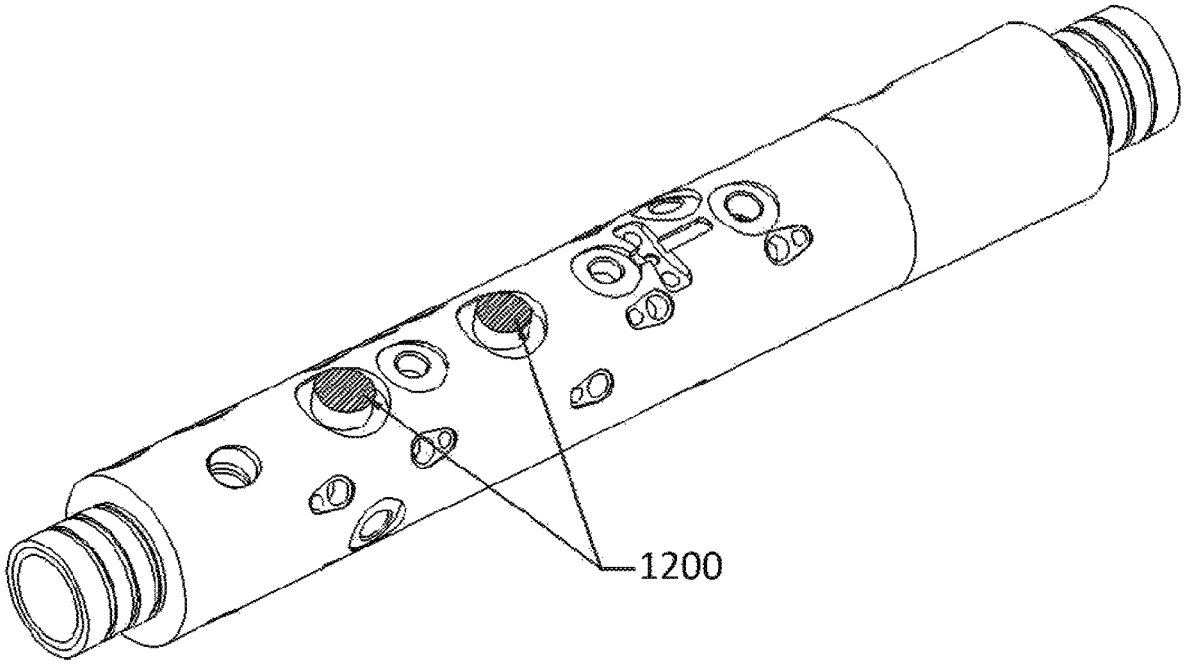
FIG. 12 is an illustration depicting the carbon fiber wrapped body with wooden plugs according to various embodiments of the present invention.

As shown in FIG. 12, the plugs (depicted as element 1100 in FIG. 11) are manually broken and removed. Some of the holes are transformed into raised tone holes by filling them with wooden plugs 1200 (or plugs formed of other suitable material). The wooden plugs 1200 are affixed within said holes using any suitable adhesive (e.g., same epoxy glue as used in carbon fiber wrapping process).

Figure 13:
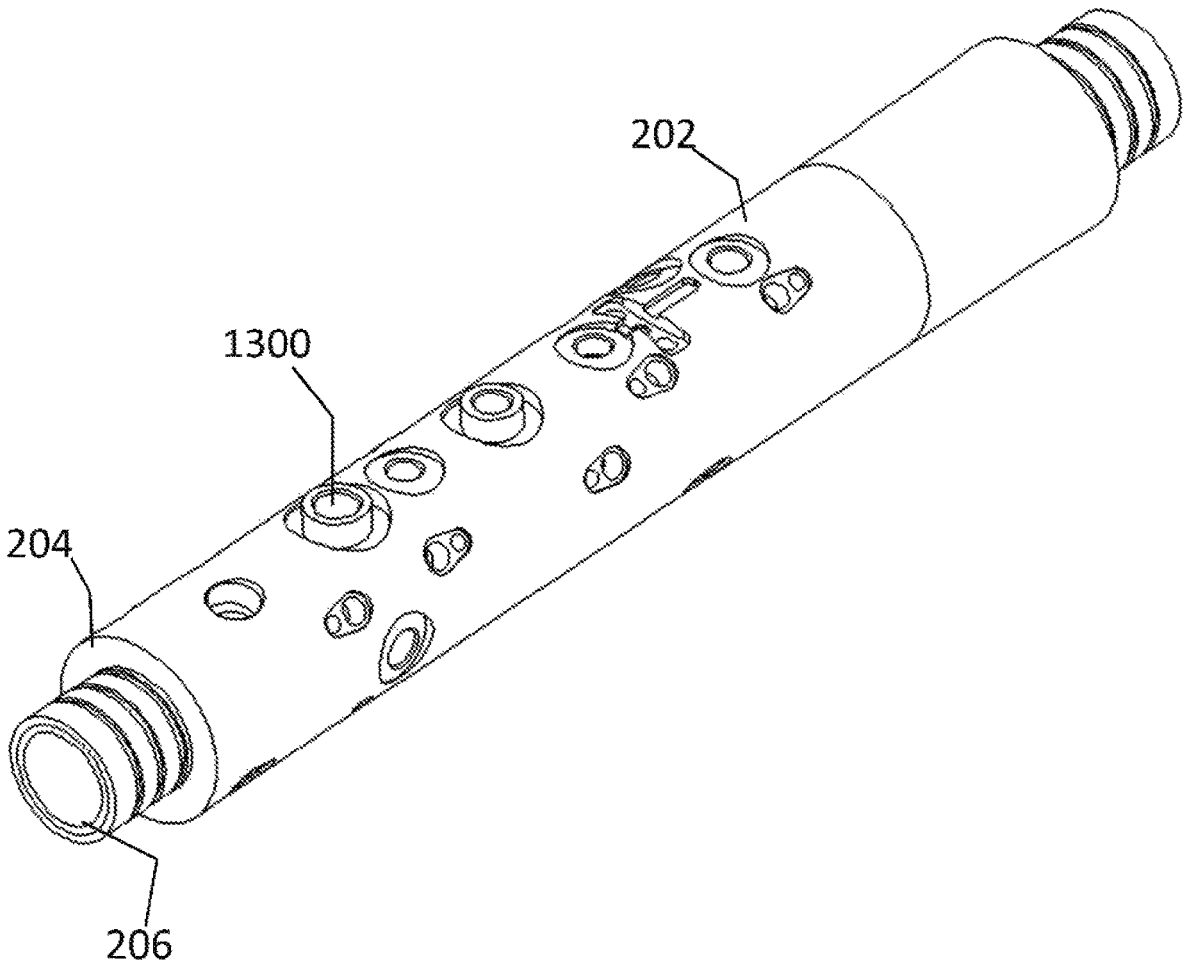
FIG. 13 is an illustration depicting the carbon fiber wrapped body joined with the wooden core according to various embodiments of the present invention.

Once cured and as shown in FIG. 13, the part is placed back in the mill and re-aligned with an infrared (IR) calibration probe. All final holes 1300 and features are machined in. The part gets a final polish and clean up, resulting in the improved body portion 202 having a carbon fiber body 204 joined with a wooden core 206. The body portion 202 is now ready for assembly in which keywork is added, along with a bell, mouthpiece, and/or any other components as applicable to the particular musical instrument to which the body portion 202 is being implemented.

Figure 14:
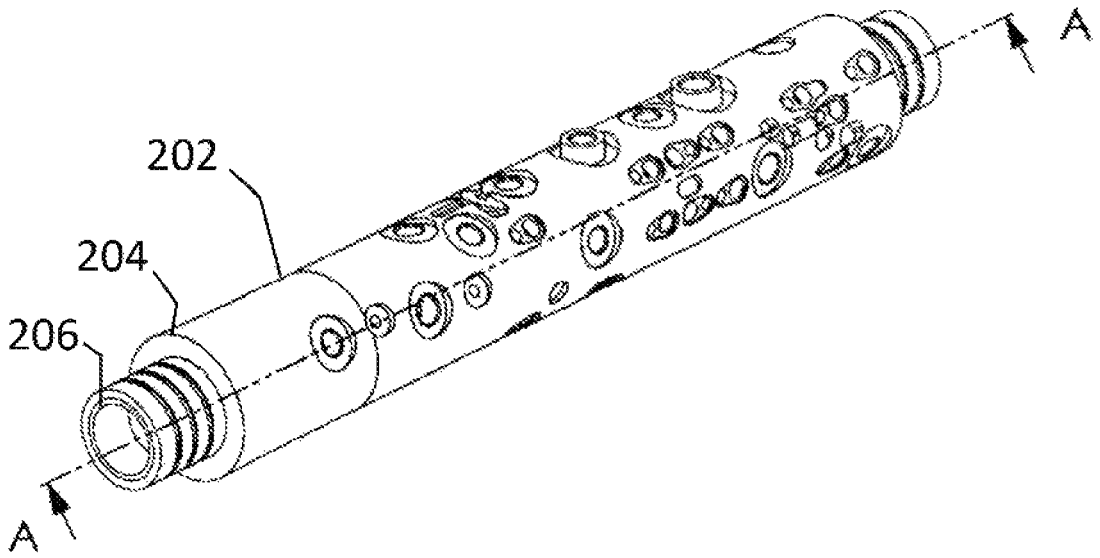
FIG. 14 is an iso-view illustration depicting the carbon fiber wrapped body joined with the wooden core according to various embodiments of the present invention.
Figure 15:
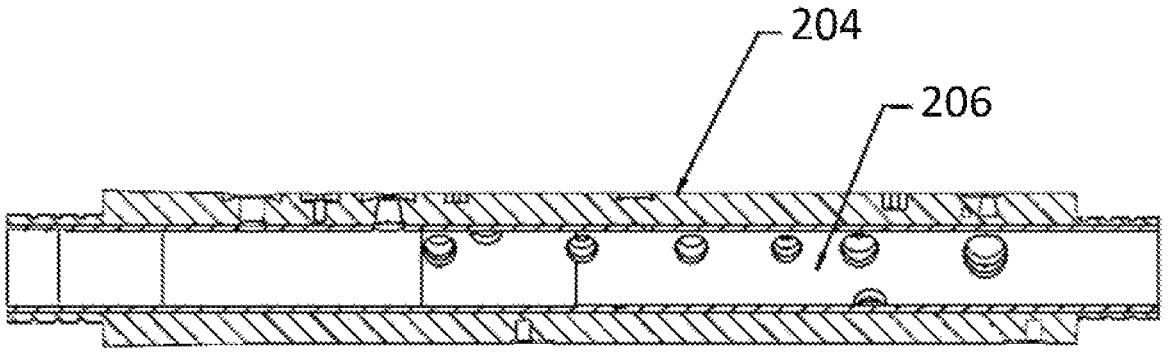
FIG. 15 is cross-sectional, side-view illustration of the carbon fiber wrapped body joined with the wooden core, taken from line A-A of FIG. 14.
Figure 16:
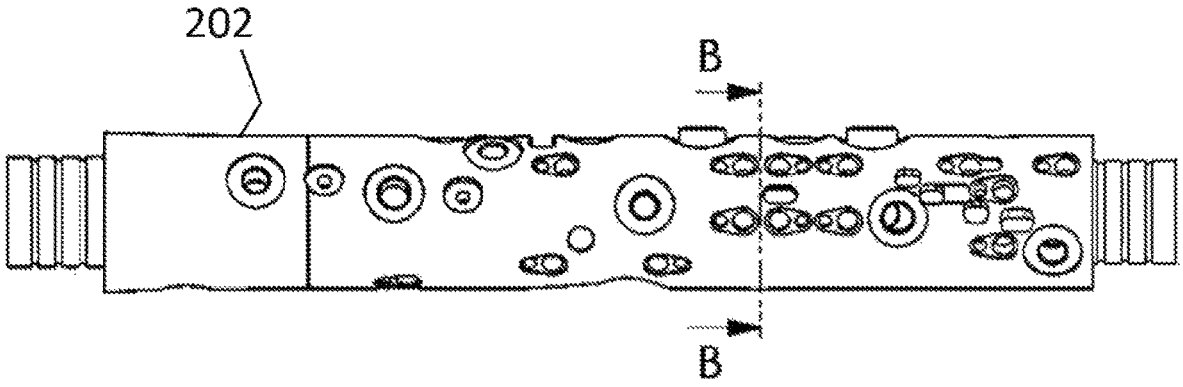
FIG. 16 is a top-view illustration depicting the carbon fiber wrapped body joined with the wooden core according to various embodiments of the present invention.
Figure 17:
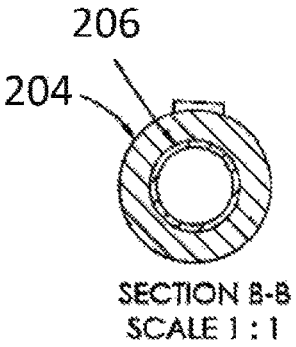
FIG. 17 is cross-sectional, rear-view illustration of the carbon fiber wrapped body joined with the wooden core, taken from line B-B of FIG. 16.

For further understanding, FIG. 14 provides an iso-view illustration of the body portion 202 having the carbon fiber wrapped body 204 joined with the wooden core 206. FIG. 15 further provides a cross-sectional, side-view illustration of the carbon fiber wrapped body 204 joined with the wooden core 206, taken from line A-A of FIG. 14. Additionally, FIG. 16 provides a top-view illustration of the improved body portion 202, while FIG. 17 is cross-sectional, rear-view illustration of the carbon fiber wrapped body 204 joined with the wooden core 206, taken from line B-B of FIG. 16.

Finally, while this invention has been described in terms of several embodiments, one of ordinary skill in the art will readily recognize that the invention may have other applications in other environments. It should be noted that many embodiments and implementations are possible. Further, the following claims are in no way intended to limit the scope of the present invention to the specific embodiments described above. In addition, any recitation of "means for" is intended to evoke a means-plus-function reading of an element and a claim, whereas, any elements that do not specifically use the recitation "means for", are not intended to be read as means-plus-function elements, even if the claim otherwise includes the word "means". Further, while particular method steps have been recited in a particular order, the method steps may occur in any desired order and fall within the scope of the present invention.

What is claimed is:

1. A musical instrument, comprising:

a body portion, the body portion having carbon fiber wrapped around and adhered to a wooden core;

wherein the wooden core includes a bore therethrough to define a flow path through which air travels in the musical instrument through the body portion;

a plurality of tone holes formed through the carbon fiber and wooden core and into the bore; and wherein the body portion includes at least two tenons, each tenon having a wooden core inner diameter and a carbon fiber outer diameter.

2. The musical instrument as set forth in claim 1, further comprising both a mouthpiece and bell affixed with the tenons.

3. A method for forming a musical instrument, comprising an act of:

forming a body portion such that the body portion includes carbon fiber wrapped around and adhered to a wooden core, wherein the wooden core includes a bore therethrough and a plurality of tone holes formed through the carbon fiber and wooden core and into the bore;

wherein forming the body portion further comprises acts of:

adhering a carbon fiber sheet to the wooden core; and forming the one or more tone holes through the carbon fiber sheet and wooden core; and wherein adhering the carbon fiber sheet to the wooden core further comprises acts of:

drilling a bore through a wooden blank to form a bore therethrough, the wooden blank having an outer diameter and inner diameter defined by the bore;

turning down the outer diameter of the wooden blank to form the wooden core;

securing the wooden core between a pair of mandrels to form a mandrel-wooden core assembly;

mounting the mandrel-wooden core assembly to a lathe;

adhering a first end of a carbon fiber sheet to the wooden core;

wrapping the carbon fiber sheet around the wooden core while applying an adhesive to the carbon fiber sheet and maintaining the carbon fiber sheet under tension to form a carbon fiber wrapped body;

wrapping and securing a securement layer around the carbon fiber wrapped body to allow the adhesive to cure; and once cured, turning down an outer diameter of the carbon fiber wrapped body such that the outer diameter of the carbon fiber wrapped body is concentric with the inner diameter defined by the bore to form a concentric tube.

4. The method as set forth in claim 3, further comprising acts of:

forming tenons on opposing ends of the concentric tube;

reinforcing the tenons by applying an adhesive around the tenons;

turning down the tenons to a desired size;

forming tone holes with blind pockets through the carbon fiber wrapped body and into the wooden core;

filling one or more of the tone holes and blind pockets with a filler;

applying an external epoxy layer around the carbon fiber wrapped body;

turning down the external epoxy layer to a final outer diameter dimension;

polishing the external epoxy layer to a desired gloss;

forming one or more raised tone holes by affixing a wooden plug in a pocket;

machining all tone holes; and cleaning the external epoxy layer, thereby forming the body portion having a carbon fiber body adhered to the wooden core.

5. The method as set forth in claim 4, wherein in turning down the outer diameter of the wooden blank to form the wooden core, an outer surface of the wooden core includes smooth flat rings wrapping around the wooden core, with a low helix thread formed between the smooth flat rings.

6. The method as set forth in claim 5, wherein the carbon fiber sheet is maintained under tension by feeding the carbon fiber sheet up a ramp toward the wooden core while a free end of the carbon fiber sheet is affixed with a weight block.

7. The method as set forth in claim 6, further comprising an act of applying hot air to the adhesive and carbon fiber sheet when wrapping the carbon fiber sheet around the wooden core.

8. The method as set forth in claim 7, wherein the securement layer is wax paper, with the wax paper being secured around the carbon fiber wrapped body using a helix of tape.

9. The method as set forth in claim 3, wherein in turning down the outer diameter of the wooden blank to form the wooden core, an outer surface of the wooden core includes smooth flat rings wrapping around the wooden core, with a low helix thread formed between the smooth flat rings.

10. The method as set forth in claim 3, wherein the carbon fiber sheet is maintained under tension by feeding the carbon fiber sheet up a ramp toward the wooden core while a free end of the carbon fiber sheet is affixed with a weight block.

11. The method as set forth in claim 3, further comprising an act of applying hot air to the adhesive and carbon fiber sheet when wrapping the carbon fiber sheet around the wooden core.

12. The method as set forth in claim 3, wherein the securement layer is wax paper, with the wax paper being secured around the carbon fiber wrapped body using a helix of tape.

13. A musical instrument formed according to the method of claim 3.

14. A musical instrument formed according to the method of claim 4.

* * * * *